US009145883B2

(12) United States Patent
Ihsl

(10) Patent No.: US 9,145,883 B2
(45) Date of Patent: Sep. 29, 2015

(54) HYDRAULIC POWER UNIT INCLUDING CERAMIC OSCILLATOR AND HYDRAULIC ENGINE INCLUDING THE HYDRAULIC POWER UNIT

(76) Inventor: Lucas Ihsl, Chungcheongnam-do (KR)

( * ) Notice: Subject to any disclaimer, the term of this patent is extended or adjusted under 35 U.S.C. 154(b) by 546 days.

(21) Appl. No.: 13/547,421

(22) Filed: Jul. 12, 2012

(65) Prior Publication Data

US 2014/0017063 A1 Jan. 16, 2014

(51) Int. Cl.
*F03B 15/02* (2006.01)
*F04B 43/09* (2006.01)

(52) U.S. Cl.
CPC ..... *F04B 43/095* (2013.01)

(58) Field of Classification Search
CPC ..... F01D 15/08; F04B 43/08; F04B 43/088; F04B 43/095
USPC ..... 60/325, 413, 456
See application file for complete search history.

(56) References Cited

U.S. PATENT DOCUMENTS

| | | | | |
|---|---|---|---|---|
| 3,902,318 | A * | 9/1975 | Becker et al. | 60/388 |
| 4,495,965 | A * | 1/1985 | Ise | 137/601.19 |
| 4,808,874 | A * | 2/1989 | Stahlhuth | 310/328 |
| 6,071,088 | A * | 6/2000 | Bishop et al. | 417/322 |
| 6,519,939 | B1 * | 2/2003 | Duff | 60/473 |
| 6,575,715 | B1 * | 6/2003 | Rastegar | 417/413.2 |
| 7,637,201 | B2 * | 12/2009 | Lin | 91/437 |
| 8,668,467 | B2 * | 3/2014 | Douglas et al. | 417/223 |
| 2009/0311116 | A1 * | 12/2009 | Bai et al. | 417/413.2 |

FOREIGN PATENT DOCUMENTS

| | | | | |
|---|---|---|---|---|
| CA | 2 614 338 | A1 | 5/2009 | |
| CA | 2614338 | A1 * | 5/2009 | B60K 8/00 |
| DE | 2 224 328 | A1 | 11/1973 | |
| DE | 102006038957 | B3 * | 1/2008 | F01C 1/20 |
| FR | 550989 | A * | 3/1923 | F04B 43/08 |
| WO | 2007/136218 | A1 | 11/2007 | |

OTHER PUBLICATIONS

European Search Report: dated Oct. 30, 2012; Appln. No. 12275105.0-2315.

* cited by examiner

*Primary Examiner* — Dwayne J White
*Assistant Examiner* — Matthew Wiblin
(74) *Attorney, Agent, or Firm* — Ladas & Parry LLP

(57) ABSTRACT

A hydraulic engine which may generate rotational power by using environmentally friendly electric energy and have improved performance and a long life span, and more particularly, environmentally friendly hydraulic power units that that may extrude a working fluid to realize an engine and has a long life span. The hydraulic engine includes: a housing; a rotor that is rotatably supported in the housing and allows rotor blades to be disposed therearound; a plurality of hydraulic power units that are disposed around the rotor to be spaced apart from one another; and an output shaft that rotates as the rotor rotates and the output shaft protrudes beyond the housing, wherein a fluid extruded from hydraulic power units pressurizes the rotor blades and generates a rotational force of the output shaft.

12 Claims, 10 Drawing Sheets

HYDRAULIC POWER UNIT INCLUDING CERAMIC OSCILLATOR AND HYDRAULIC ENGINE INCLUDING THE HYDRAULIC POWER UNIT

BACKGROUND OF THE INVENTION

1. Field of the Invention

The present invention relates to a hydraulic power unit and a hydraulic engine including the same, and more particularly, to a hydraulic power unit that includes a ceramic oscillator and may introduce or extrude a fluid due to an operation of the ceramic oscillator, and a hydraulic engine that includes the hydraulic power unit and generates a rotational force.

2. Description of the Related Art

Power, which is used for driving vehicles, various machines, or mechanisms, is usually obtained by burning fossil fuel. When fossil fuel is burnt, a lot of carbon dioxide is generated and various other harmful materials are produced, thereby polluting the environment. Also, since there is a limited amount of fossil fuel such as crude oil or coal on the earth, there is a limitation to depending on such fossil fuel. Accordingly, attempts to find new energy sources and develop methods of efficiently using existing energy sources have been conducted.

Results of the attempts made so far include a method of generating electric energy by charging batteries to power vehicles or other machines and a hybrid method using both combustion of fossil fuel and energy from batteries. However, there is a performance limitation with respect to conventional power systems (engines) using electric energy. Accordingly, there is a demand for a power system which does not generate carbon dioxide, generates environmentally friendly electric energy, and has improved performance and a long life span.

SUMMARY OF THE INVENTION

The present invention provides an engine which may generate rotational power by using environmentally friendly electric energy and may have improved performance and a long life span.

The present invention also provides an environmentally friendly hydraulic power unit that may extrude a working fluid to realize an engine and may have a long life span.

According to an aspect of the present invention, there is provided a hydraulic engine including: a housing; a rotor that is rotatably supported in the housing and allows rotor blades to be disposed therearound; a plurality of hydraulic power units that are disposed around the rotor to be spaced apart from one another; and an output shaft that rotates as the rotor rotates and the output shaft protrudes beyond the housing, wherein each of the plurality of hydraulic power units includes: a hydraulic tube that has a cavity therein, allows a fluid inlet through which a fluid may be introduced and a fluid outlet through which a fluid may be extruded to be formed in a surface thereof, and has a front end portion closed, wherein the fluid inlet and the fluid outlet are formed as V-shaped grooves, an outer check ring that is formed of an elastic material and is disposed to be attached to the outer V-shaped groove of the hydraulic tube to close the fluid outlet; an inner check ring that is formed of an elastic material and is disposed to be attached to the inner V-shaped groove of the hydraulic tube to close the fluid inlet in the cavity of the hydraulic tube; an oscillation tube that includes an insulating oil chamber that includes an elastic tube layer in which a cavity is formed and a metal tube layer disposed around an outer circumferential surface of the elastic tube layer, and a transmission holder that is disposed on a rear end portion of the insulating oil chamber and receives a force applied from an oscillator; an amplitude amplification device that includes a casing that is disposed under the oscillation tube and has a cavity therein, a swell tube that is disposed in the casing, has a cylindrical shape with a cavity therein, and has a plurality of slits formed in a longitudinal direction in a surface thereof; and an elastic chip that is disposed in the swell tube to cross the cavity of the swell tube; the oscillator that is disposed under the amplitude amplification device to be deformed toward or away from the hydraulic tube, and increases or reduces a pressure of a fluid in the hydraulic tube and the oscillation tube; and an oscillation front end portion that is partially inserted into the swell tube and is connected to the oscillator.

When electric energy is applied to the oscillator, the oscillator may be deformed due to a converse piezoelectric effect toward or away from the cavity of the hydraulic tube.

The amplitude amplification device may be configured such that a portion of the transmission holder and a portion of the oscillator front end portion are inserted into the cavity of the swell tube, and the elastic chip is disposed between the transmission holder and the oscillator front end portion, wherein the elastic chip is formed of an elastic material and has a restoring force to return to its original shape after being deformed, has a circular plate shape having a curvature and a protruding central portion, and has a plurality of holes formed in a circumferential direction thereof.

The plurality of holes may have fan shapes each having a portion of a circumferential surface of the elastic chip as an arc.

A plurality of slits which extend in a longitudinal direction may be formed in the metal tube layer.

A protrusion that helps the hydraulic tube to be kept deformed inward may be formed on a rear end of the oscillation tube.

A plurality of the fluid inlets may be formed around the hydraulic tube, and a plurality of the inner check rings may be disposed to contact V-shaped grooves of the plurality of fluid inlets and close the plurality of fluid inlets.

A plurality of the fluid outlets may be formed around the hydraulic tube, and a plurality of the outer check rings may have ring shapes, may be disposed to contact V-shaped grooves of the plurality of fluid outlets, and may close the plurality of fluid outlets.

The hydraulic engine may further include a front end accumulation unit that is disposed on a closed front end of the hydraulic tube, wherein the front end accumulation unit includes an accumulation plate, a front end cap, a spring guide tube, and a spring, wherein the spring is disposed between the front end cap and the accumulation plate and applies an elastic force between the front end cap and the accumulation plate.

The hydraulic engine may further include an insulating oil circulation cooling device, wherein the insulating oil circulation cooling device is disposed to connect at least two hydraulic power units, and includes: a first pipeline and a second pipeline that connect the hydraulic power units; a valve unit that connects the first pipeline and the second pipeline; a third pipeline that is connected to the first pipeline and the second pipeline and is provided with cooling effect of a cooler; a first check ball receiving portion that is disposed in the first pipeline; a first check ball that is inserted into the first check ball receiving portion and is elastically deformable; and a second check ball that is disposed between the hydraulic power units and the first pipeline and is elastically deformable.

The hydraulic engine may further include a sleeve flange on which the rotor and the hydraulic power units may be disposed, wherein the sleeve flange includes: a cavity in which the rotor is disposed; a plurality of arrangement holes that are disposed outside the cavity and allow the hydraulic power units to be disposed therein; a plurality of extrusion slots that are formed in a front portion of a side surface of the sleeve flange with the cavity and extend in a longitudinal direction; and a plurality of introduction slots that are formed in a rear portion of the side surface of the sleeve flange with the cavity and extend in the longitudinal direction, wherein the rotor includes double helical blades, and is inserted into the cavity of the sleeve flange.

The hydraulic engine may further include a driving module that drives the hydraulic power units, adjusts the number of rotations and torque of the rotor, and includes a secondary battery as a driving power source.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown.

Figure 1:
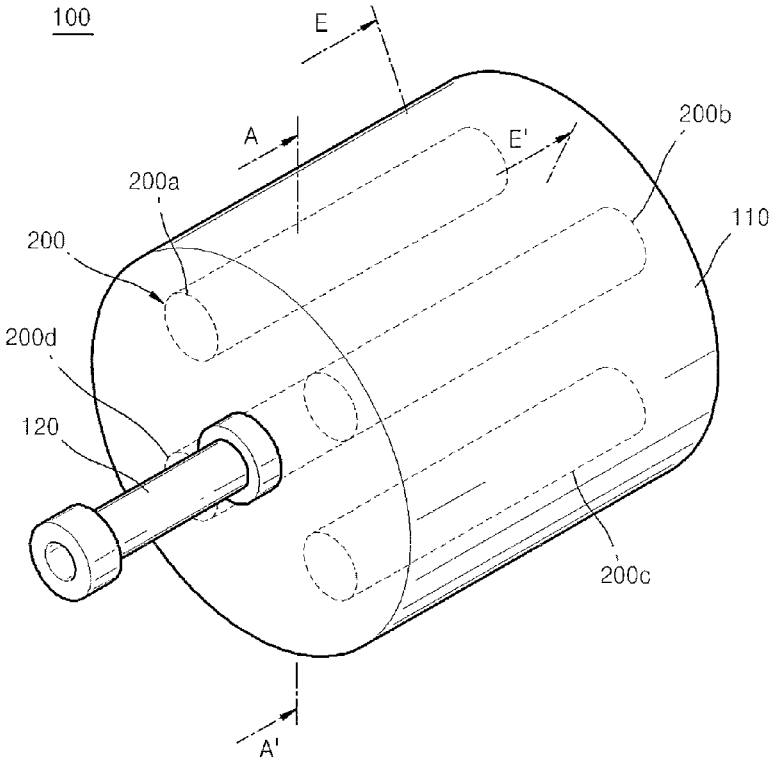
FIG. 1 is a perspective view illustrating a hydraulic engine according to an embodiment of the present invention.
Figure 2:
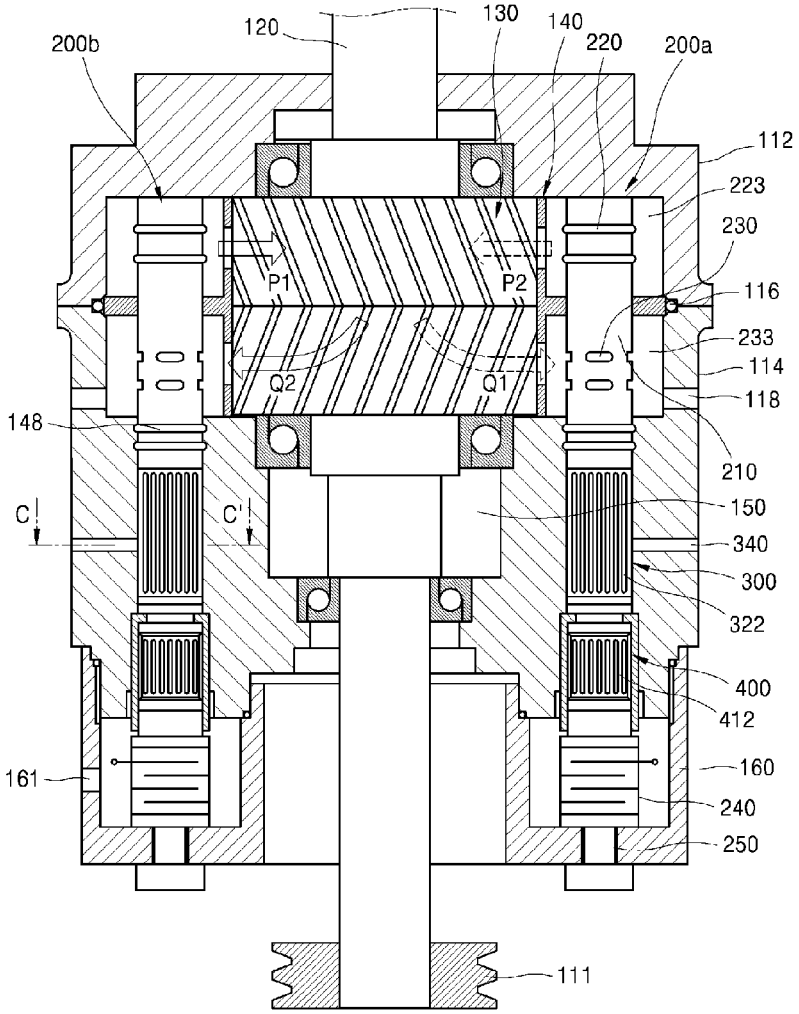
FIG. 2 is a cross-sectional view illustrating the hydraulic engine of FIG. 1.
Figure 3:
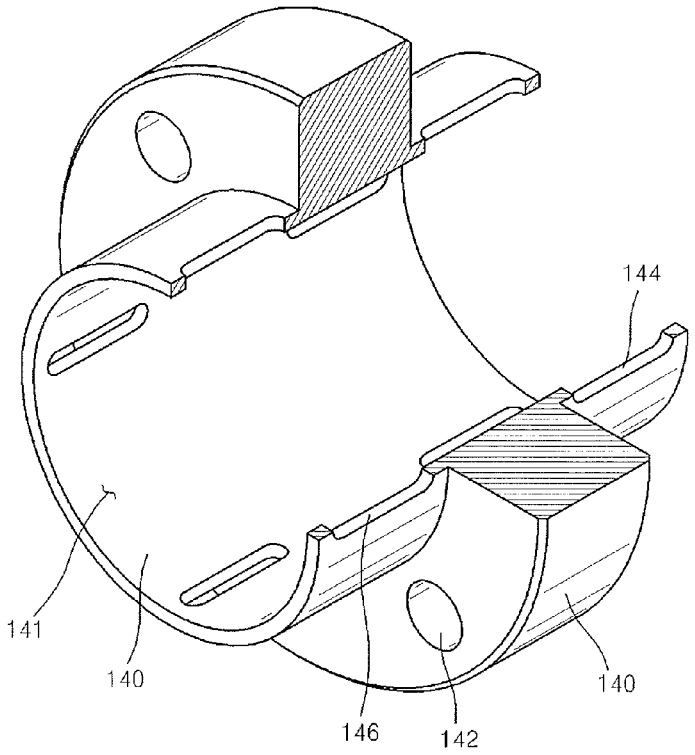
FIG. 3 is a perspective view illustrating a sleeve flange of the hydraulic engine of FIG. 1.
Figure 4:
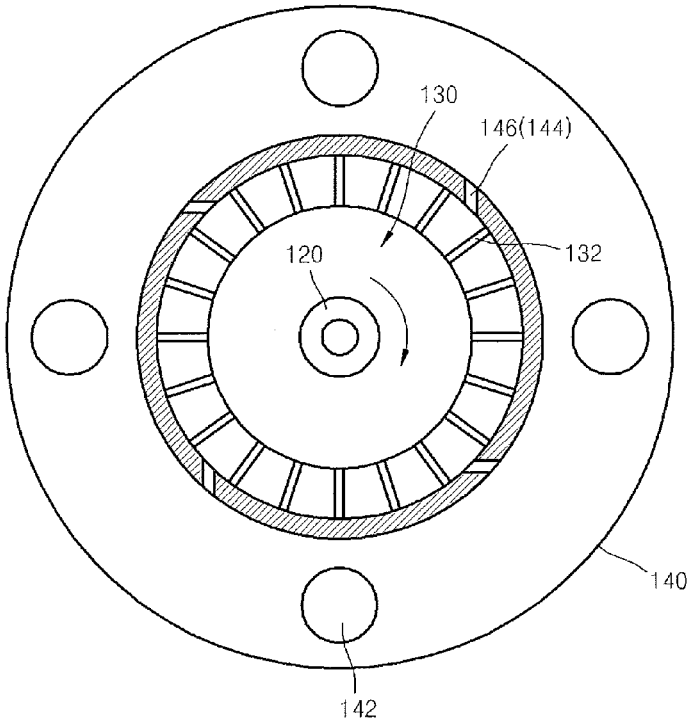
FIG. 4 is a cross-sectional view illustrating the sleeve flange of FIG. 3.
Figure 5:
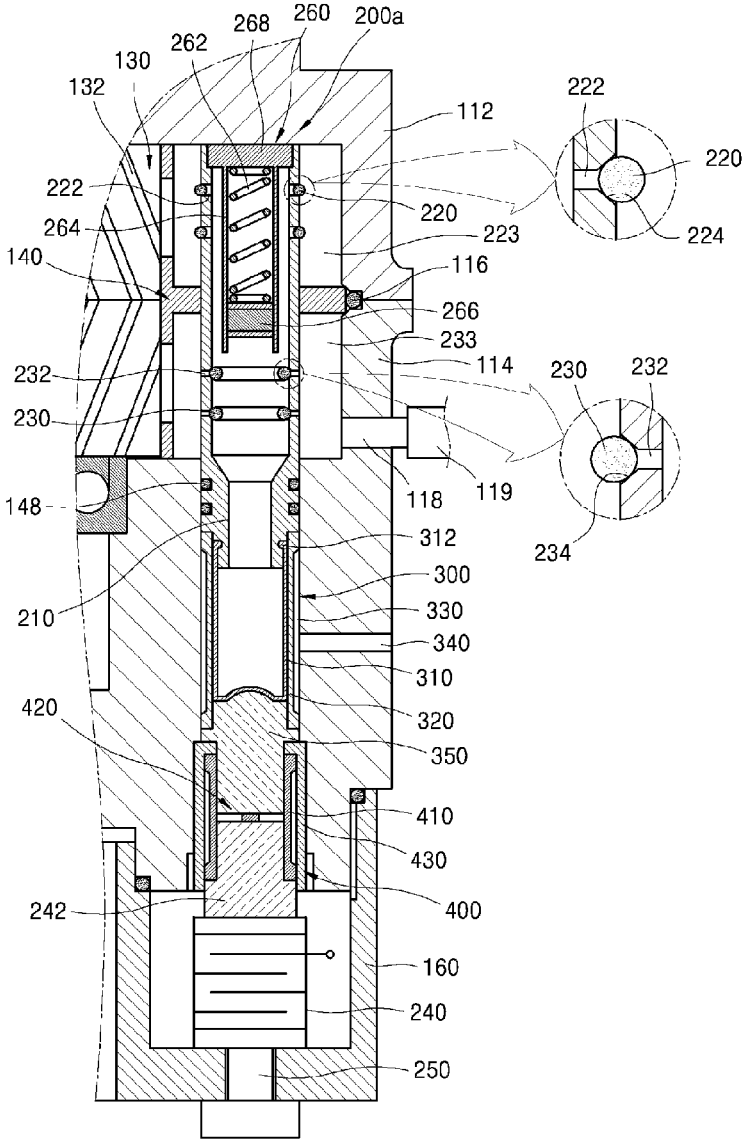
FIG. 5 is a cross-sectional view illustrating one of hydraulic power units.
Figure 6:
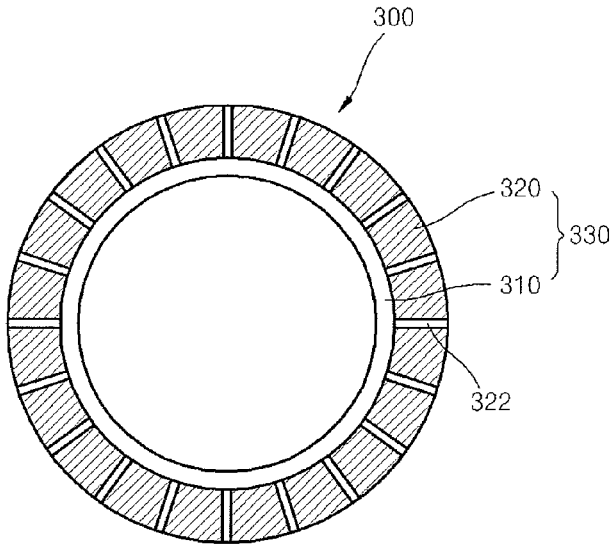
FIG. 6 is a cross-sectional view illustrating an oscillation tube.
Figure 7:
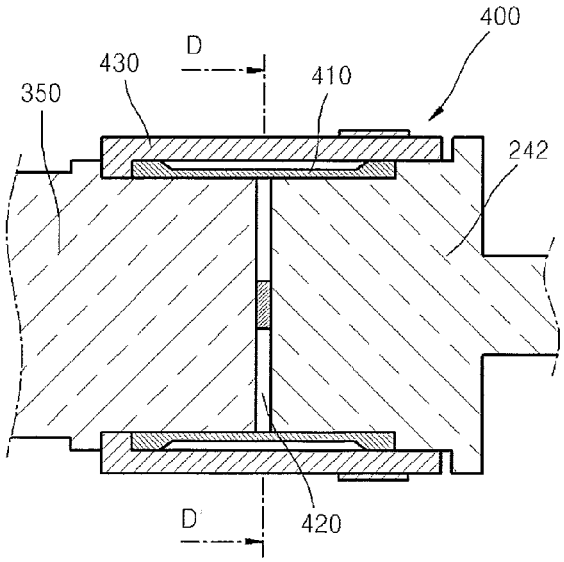
FIG. 7 is a cross-sectional view illustrating an amplitude amplification device.
Figure 8:
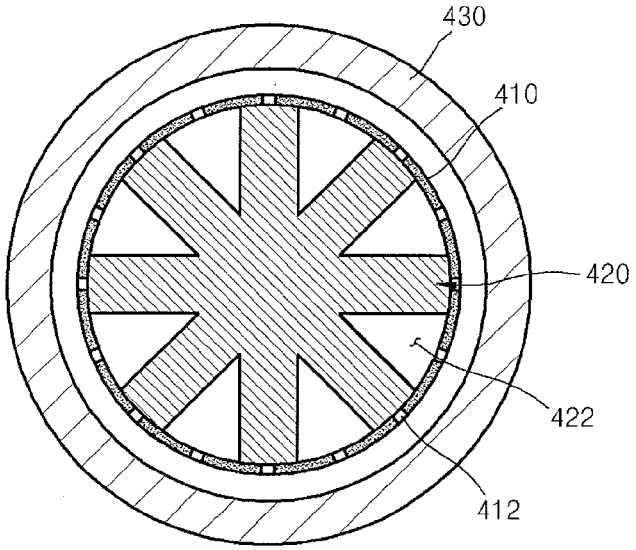
FIG. 8 is a cross-sectional view illustrating the amplitude amplification device.
Figure 9:
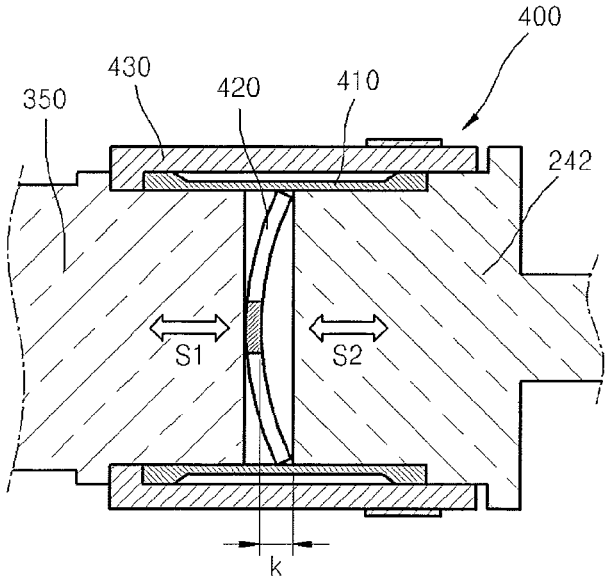
FIGS. 9 and 10 are cross-sectional views for explaining an operation of the amplitude amplification device of FIG. 8.
Figure 10:
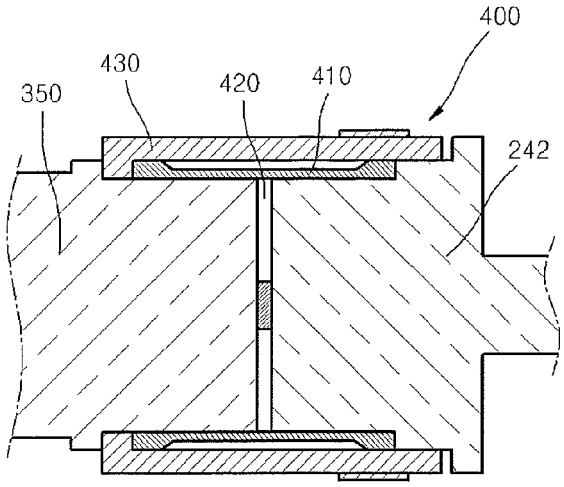
Figure 11:
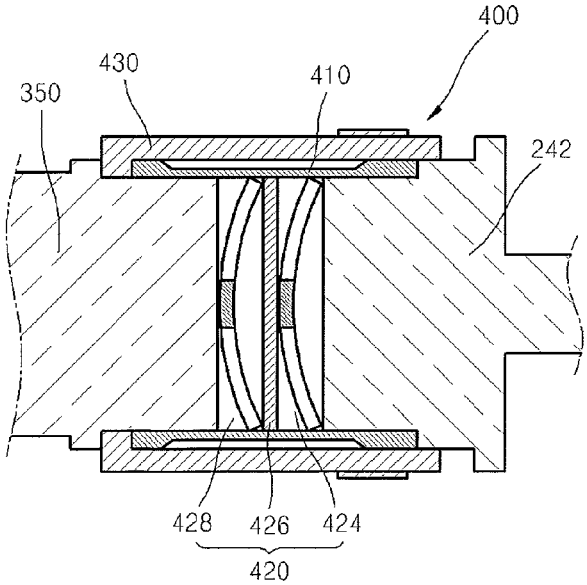
FIG. 11 is a cross-sectional view illustrating the amplitude amplification device of FIG. 8.
Figure 12:
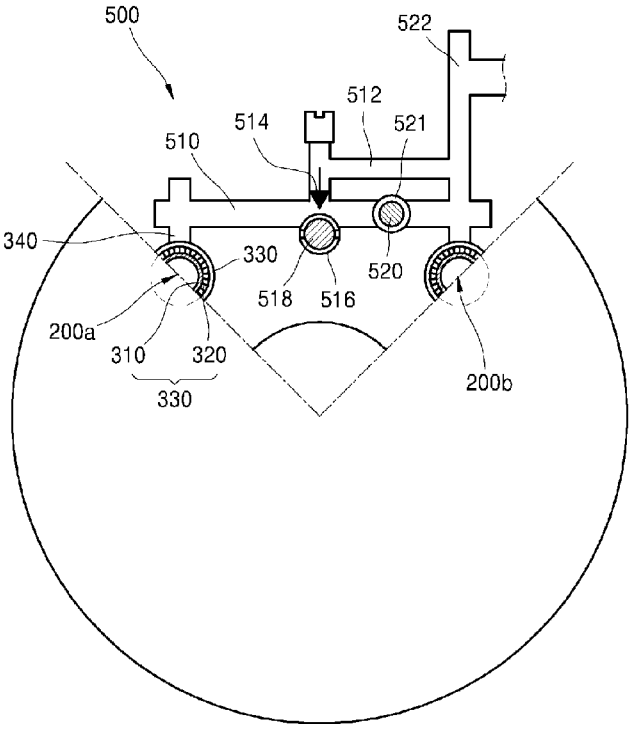
FIG. 12 is a view illustrating an insulating oil circulation cooling device in the hydraulic engine of FIG. 1.
Figure 13:
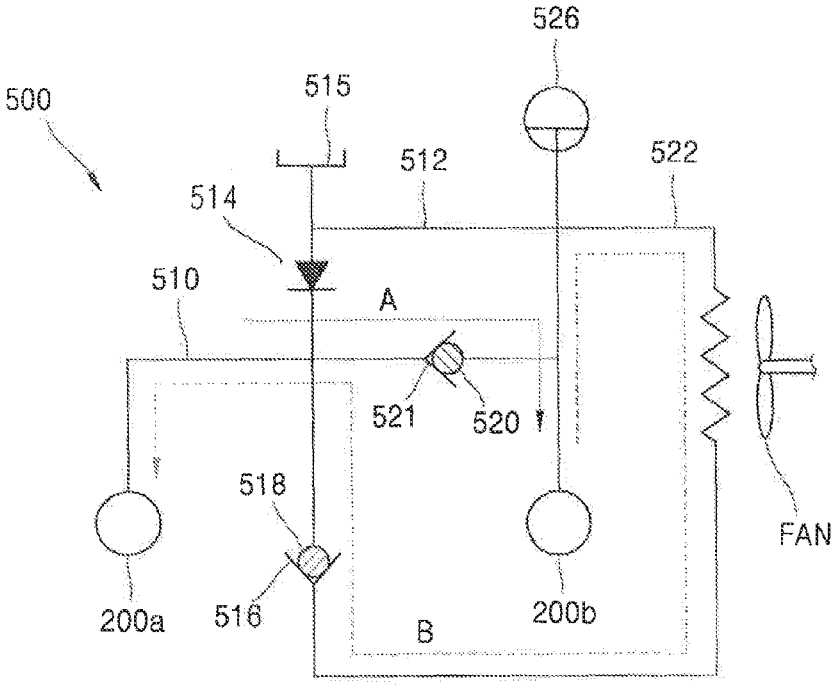
FIG. 13 is a circuit diagram for explaining an operation of the insulating oil circulation cooling device of FIG. 12.

FIG. 1 is a perspective view illustrating a hydraulic engine 100 according to an embodiment of the present invention. FIG. 2 is a cross-sectional view illustrating the hydraulic engine 100 of FIG. 1. FIG. 3 is a perspective view illustrating a sleeve flange 140 of the hydraulic engine 100 of FIG. 1. FIG. 4 is a cross-sectional view illustrating the sleeve flange 140 of FIG. 3. FIG. 5 is a cross-sectional view illustrating one of hydraulic power units 200. FIG. 6 is a cross-sectional view illustrating an oscillation tube 300. FIG. 7 is a cross-sectional view illustrating an amplitude amplification device 400. FIG. 8 is a cross-sectional view illustrating the amplitude amplification device 400. FIGS. 9 and 10 are cross-sectional views for explaining an operation of the amplitude amplification device 400 of FIG. 8. FIG. 11 is a cross-sectional view illustrating the amplitude amplification device 400 of FIG. 8. FIG. 12 is a view illustrating an insulating oil circulation cooling device 500 in the hydraulic engine 100 of FIG. 1. FIG. 13 is a circuit diagram for explaining an operation of the insulating oil circulation cooling device 500 of FIG. 12.

FIG. 2 is a cross-sectional view taken along line A-A' of FIG. 1 and FIG. 12 is a cross-sectional view taken along line E-E' of FIG. 1.

Referring to FIGS. 1 through 13, the hydraulic engine 100 includes a housing 110, a rotor 130, an output shaft 120, and a plurality of hydraulic power units 200.

The housing 110 defines an outer shape of the hydraulic engine 100. The rotor 130 and the plurality of hydraulic power units 200 may be disposed in the housing 110.

The rotor 130 which is rotatably disposed in the housing 110 includes a plurality of rotor blades 132 that protrude in a radial direction of the rotor 130 about a rotational shaft of the rotor 130. The rotor 130 may have a structure similar to that of a double helical gear.

The output shaft 120, which is formed by extending the rotational shaft of the rotor 130 disposed in the sleeve flange 140 or is integrally formed with the rotational shaft of the rotor 130, protrudes beyond the housing 110.

A hydraulic oil cooling pump chamber 150 may be provided beside the output shaft 120.

An even number of, for example, four, hydraulic power units 200 which enable a fluid to be extruded or introduced in a tangential direction of the rotor 130 from or into the plurality of rotor blades 132 disposed on the rotor 130 may be provided around the rotor 130. However, the number of the hydraulic power units 200 included in the hydraulic engine 100 is not limited to four, and two or more hydraulic power units 200 may be provided as long as every two hydraulic power units may operate as a pair. If the hydraulic power units 200 are grouped into sets, each set may include two hydraulic power units 200, one common accumulator which will be explained below may be provided outside the housing 110 of the hydraulic engine 100, and the hydraulic power units 200 may communicate with a common introduction chamber 233 and a common extrusion chamber 223.

In the hydraulic engine 100 of FIG. 1, from among the four hydraulic power units 200 disposed around the rotor 130, every two hydraulic power units 200 operate as a pair and enable a fluid to flow.

That is, when the hydraulic power units 200 disposed around the rotor 130 are referred to as first through fourth hydraulic power units 200*a*, 200*b*, 200*c*, and 200*d* clockwise, an extrusion operation of the first and third hydraulic power units 200*a* and 200*c* and an introduction operation of the second and fourth hydraulic power units 200*b* and 200*d* may be simultaneously performed. In this case, a fluid extruded from the first and third hydraulic power units 200*a* and 200*c* may pass through the common extrusion chamber 223 in front of the sleeve flange 140, pass through extrusion slots 146 formed in a front portion of the sleeve flange 140, and pressurize the rotor blades 132 of the rotor 130 disposed in a cavity 141 of the sleeve flange 140 to rotate the rotor 130. The fluid may pass through a plurality of introduction slots 144 formed in a rear portion of the sleeve flange 140, pass through the common introduction chamber 233, and may be introduced into inlets of the second and fourth hydraulic power units 200*b* and 200*d*. The common extrusion chamber 223 and the common introduction chamber 233 may be separated from each other by the sleeve flange 140. When the hydraulic engine 100 is driven by using the hydraulic power units 200, every two hydraulic power units 200 may constitute one set and may communicate with the common introduction chamber 233 and the common extrusion chamber 223.

When each of the hydraulic power units 200 operates in reverse order by making a fluid flow in the same direction, rotational power may be applied to the rotor 130.

The hydraulic engine 100 may be used by connecting the output shaft 120 of the hydraulic engine 100 to vehicles or mechanical devices requiring a rotational force by means of power transmission elements such as pulleys, belts, or gears. That is, a member such as a pulley 111 may be coupled to the output shaft 120.

Referring to FIG. 2, the first and second hydraulic power units 200*a* and 200*b* are disposed at both sides of the rotor 130.

For easy attachment and detachment, the housing 110 may include a cover 112 and a main body housing 114, and a seal member 116 may be disposed between the cover 112 and the main body housing 114 to prevent fluid leakage.

FIG. 3 illustrates the sleeve flange 140. Referring to FIG. 3, the sleeve flange 140 may act as a framework of the hydraulic engine 100, and arrangement holes 142 that allow the hydraulic power units 200 to be disposed at right positions may be formed in the sleeve flange 140. Also, the sleeve flange 140 may have a cylindrical shape having the cavity 141 in which the rotor 130 is disposed, and the introduction slots 144 and the extrusion slots 146 may be formed in the sleeve flange 140 such that a fluid may flow between the hydraulic power units 200 and the rotor 130. The introduction slots 144 may be formed in the rear portion of the sleeve flange 140, and the extrusion slots 146 may be formed in the front portion of the sleeve flange 140. The introduction slots 144 and the extrusion slots 146 may extend in a longitudinal direction of the sleeve flange 140. As shown in FIG. 3, the introduction slots 144 and the extrusion slots 146 may be inclined in a tangential direction of the rotor 130 instead of a radial direction of the rotor 130 such that a fluid introduced or extruded into or from the hydraulic power units 200 may easily rotate the rotor 130 through the rotor blades 132.

Each of the hydraulic power units 200 includes a front end accumulation unit 260, a hydraulic tube 210, the oscillation tube 300, the amplitude amplification device 400, and an oscillator 240.

The front end accumulation unit 260 is provided on a front end portion of each of the first and second hydraulic power units 200*a* and 200*b*. The front end accumulation unit 260 does not need to be provided on all hydraulic power units 200, and may be provided on only one, from among the plurality of hydraulic power units 200 which operate in pairs, which extrudes a fluid by using a first driving signal.

The front end accumulation unit 260 which absorbs a fluid first extruded in the hydraulic tube 210 includes a front end cap 268, a spring 262, a spring guide tube 264, and an accumulation plate 266. The front end cap 268 is coupled to the hydraulic tube 210, and both ends of the spring 262 are coupled to the front end cap 268 and the accumulation plate 266.

After a plurality of seal grooves 148 are formed in an outer surface of a rear end portion of the hydraulic tube 210, the hydraulic tube 210 and the oscillation tube 300 may be coupled to each other by disposing a seal member in the seal grooves 148.

The hydraulic tube 210 contains a working fluid. A front end portion of the hydraulic tube 210 is coupled, sealed, and tightly shut, and at least one fluid outlet 222 and at least one fluid inlet 232 are formed in the hydraulic tube 210.

An inner check ring 230 is mounted in the fluid inlet 232 formed in the hydraulic tube 210, and the inner check ring 230 opens or closes the fluid inlet 232. Preferably, a V-shaped groove 234 may be formed along an inner wall of the hydraulic tube 210 in a portion of the hydraulic tube 210 in which the fluid inlet 232 is formed, and the inner check ring 230 may be mounted in the V-shaped groove 234.

An outer check ring 220 is mounted in the fluid outlet 222 formed in the hydraulic tube 210, and the outer check ring 220 opens or closes the fluid outlet 222. Preferably, a V-shaped groove 224 is formed along an outer wall of the hydraulic tube 210 in a portion of the hydraulic tube 210 in which the fluid outlet 222 is formed, and the outer check ring 220 is mounted in the V-shaped groove 224.

The inner check ring 230 and the outer check ring 220 may be formed of an elastic material to be deformed. Accordingly, as the inner check ring 230 and the outer check ring 220 are deformed, a fluid may be introduced into the hydraulic tube 210 through the fluid inlet 232, or may be extruded from the hydraulic tube 210 through the fluid outlet 222.

The outer check ring 220 may have a ball shape, instead of a ring shape, and may perform the same function. For example, after a ball sheet on which a check ball is mounted is formed on the fluid outlet 222, an outer housing may be provided to attach the check ball to the fluid outlet 222. In this case, the check ball may be kept slightly pressurized between the fluid outlet and the outer housing. When a pressure in the hydraulic tube 210 is increased, the check ball may be deformed to open the fluid outlet. Also, when a pressure in the hydraulic tube 210 is reduced, the check ball may be attached to the fluid outlet to close the fluid outlet.

The hydraulic tube 210 may be connected to a pipe hole 118, and the pipe hole 118 may be connected to an accumulator 119.

The oscillation tube 300 may be deformed to reduce a volume in the hydraulic tube 210 and the oscillation tube 300 as the oscillator 240 operates. Accordingly, the oscillation tube 300 is used to overcome the fact that an oscillation amplitude of the oscillator 240 is limited and to increase the amount of a fluid flowing as the oscillator 240 moves. The oscillation tube 300 has a two-layer structure including a metal tube layer 320 and an elastic tube layer 310, and includes an insulating oil chamber 330 disposed outside the metal tube layer 320. A plurality of slits 322 are formed in a longitudinal direction in the metal tube layer 320.

FIG. 6 is a cross-sectional view illustrating the oscillation tube 300.

Referring to FIG. 6, the oscillation tube 300 includes two layers. The elastic tube layer 310 which is an inner layer of the two layers and is easily elastically deformed and restored may be formed of, for example, urethane or rubber. The metal tube layer 320 which is an outer layer of the two layers is formed of a metal material. The plurality of slits 322 are formed in the longitudinal direction at predetermined intervals in a circumferential direction of the metal tube layer 320 in the metal tube layer 320.

Since the metal tube layer 320 is formed of a material having an elastic modulus higher than that of the elastic tube layer 310 but the slits 322 are formed in the metal tube layer 320, the metal tube layer 320 may be deformed toward the hydraulic tube 210 and restored.

Since a protrusion 312 is formed on an end portion of the elastic tube layer 310 and a groove for receiving the protrusion 312 is formed in an end of the hydraulic tube 210, the elastic tube layer 310 is firmly fixed to the hydraulic tube 210.

The insulating oil chamber 330 in which insulating oil may be filled may be formed around the metal tube layer 320 to have a predetermined gap from the main body housing 114, and may have a cylindrical shape disposed between the main body housing 114 and the metal tube layer 320.

A cooling pipe 340 may be formed at a side of the oscillation tube 300 to be connected to an insulating oil circulation cooling device which will be explained below. A transmission holder 350 for transmitting a force by deforming the oscillator 240 is disposed at a lower end of the oscillation tube 300.

The oscillator 240 is disposed on a rear end portion of each of the hydraulic power units 220, and may be deformed in a longitudinal direction of the hydraulic power units 200. The oscillator 240 includes piezoelectric elements, and preferably, may have a structure in which the piezoelectric elements are stacked. An oscillator front end portion 242 for transmitting a force by deforming the oscillator 240 may be disposed on a front end of the oscillator 240. Also, a connection device 250 may be disposed on a driving module (not shown) for driving the oscillator 240.

The driving module may drive the hydraulic power units 200 by applying an operation signal to the oscillator 240, adjust the number of rotations and torque of the rotor 130, and include a secondary battery as a driving power source.

An oscillator housing 160 that surrounds the oscillator 240 may be disposed under the main body housing 114. Insulating oil may be filled in the oscillator housing 160 to dissipate heat generated when the oscillator 240 operates. A pipe 161 in which the insulating oil flows may communicate with the insulating oil circulation cooling device 500 as will be described below.

The amplitude amplification device 400 is disposed between the oscillator 240 and the oscillation tube 300. Although the oscillator 240 is deformed to a limited extent, the amplitude amplification device 400 further increases a hydraulic force by increasing the amount of a fluid flowing in the hydraulic tube 210, and increases outputs of the hydraulic power units 200.

The amplitude amplification device 400 includes a casing 430, a swell tube 410, and an elastic chip 420.

The casing 430 may act as a housing of the amplitude amplification device 400 and may have a cylindrical shape in which a cavity is formed. A holder such as a predetermined protrusion may be provided on an end portion or on both end portions of the casing 430 to firmly fix the amplitude amplification device 400, like in the oscillation tube 300. A screw portion may be formed on an outer surface of the casing 430 to firmly couple the casing 430 to the main body housing 114.

The swell tube 410 may be disposed in the casing 430 and may have a cylindrical shape in which a cavity is formed like that of the casing 430. A plurality of slits 412 may be formed in a longitudinal direction on a surface of the swell tube 410, like in the metal tube layer 320.

Referring to FIG. 8, the elastic chip 420 is disposed in the swell tube 410 and has a circular plate shape crossing the cavity of the swell tube 410 before being deformed. The elastic chip 420 is disposed between the oscillator front end portion 242 and the transmission holder 350 in the swell tube 410. A plurality of holes 422 are formed in the elastic chip 420 in a circumferential direction of the elastic chip 420. The holes 422 may be arranged in a radial direction and each may have a fan shape having an inner surface of the cavity as an arc as shown in FIG. 8.

The elastic chip 420 may be formed of an elastic material to return to its original shape, for example, a thin film formed of a metal. The elastic chip 420 may have a curved shape which has a curvature and thus a protruding central portion like a portion of a lens or a spherical surface. Accordingly, the elastic chip 420 may be flattened or curved according to whether an external force applied to the elastic chip 420 is increased or reduced or whether there exists an external force. In this case, the elastic chip 420 which is formed of an elastic material has a restoring force to return to its original shape after being deformed.

Since the elastic chip 420 is disposed between the oscillator front end portion 242 and the transmission holder 350 to receive a force applied by the oscillator front end portion 242 and the transmission holder 350, when there is no external force, the elastic chip 420 remains flattened. Next, when an external force is applied due to the oscillator 240, the elastic chip 420 is deformed to be curved due to its restoring force.

An operation of the amplitude amplification device 400 will be explained as follows.

Referring to FIG. 9, when an external force is applied due to the oscillator 242, the elastic chip 420 may be curved to have a protruding central portion. The elastic chip 420 may be repeatedly deformed and restored as an external force is applied due to the oscillator 240 disposed on a lower end portion of each of the hydraulic power units 200.

For example, when the oscillator 240 is deformed in a forward direction to increase a pressure in the hydraulic tube 210, the swell tube 410 is deformed inward through the oscillator front end portion 242 and the elastic chip 420 is pressurized to be flattened. Since the elastic chip 420 is formed of an elastic material and has a restoring force as described above, the elastic chip 420 returns to its original shape and a force generated due to the oscillator 242 pushes the transmission holder 350 and is applied to the oscillation tube 300. The force generated due to the deformed oscillator 240 pressurizes a fluid in the hydraulic tube 210, and thus the inner check ring 230 is attached to the fluid inlet 232 to continuously close the fluid inlet 232 and the outer check ring 220, whose stiffness is less than that of a wall surface of the hydraulic tube 210, is deformed to make the fluid be extruded through the fluid outlet 222.

Since the elastic chip 420 is disposed between the oscillator front end portion 242 and the transmission holder 350 to receive a force applied by the oscillator front end portion 242 and the transmission holder 350, when there is no external force due to the oscillator 240, the elastic chip 420 remains flattened as shown in FIG. 10.

Referring to FIG. 11, a plurality of the elastic chips 420 may be provided. For example, a first elastic chip 424 and a second elastic chip 428 may be provided. A support plate 426 that fixedly supports the first and second elastic chips 424 and 428 and enables a force to be applied in a longitudinal direction of the hydraulic power units 200 may be disposed between the elastic chips 420.

An operation of each of the hydraulic power units 200 used in the hydraulic engine 100 will be explained below.

When the oscillator 240 is deformed to reduce a volume in the hydraulic tube 210, the oscillation tube 300 is deformed inward and a pressure in the hydraulic tube 210 is increased. Accordingly, the fluid inlet 232 is closed by the inner check ring 230, and the outer check ring 220 is deformed to extrude a working fluid through the fluid outlet 222. Also, the fluid passing through the fluid outlet 222 is extruded through the extrusion slots 146 of the common extrusion chamber 223 toward the rotor blades 132.

On the contrary, when the oscillator 240 is deformed to restore the volume in the hydraulic tube 210, the oscillation tube 300 returns to its original position and the pressure in the hydraulic tube 210 is reduced. Accordingly, the fluid inlet 232 is opened, a working fluid is introduced into the hydraulic tube 210 through the introduction slots 144 of the common introduction chamber 233, and the oscillation tube 300 returns to its original position.

The front end accumulation unit 260 for uniformly maintaining a slight difference between the amount of a driving fluid extruded and the amount of a fluid introduced between one pair of hydraulic power units 200 is disposed on a front end portion of at least one hydraulic power unit 200.

The front end accumulator 260 helps a fluid which initially stands still in the hydraulic tube 210 so as to flow fast when the hydraulic engine 100 starts up. That is, when the oscillator 240 moves to apply a pressure for start-up, the spring 262 of the front end accumulator 260 is compressed to absorb a fluid, store power, and enable fast start-up. A fluid is accumulated, due to the movement of the oscillator 240, on the front end portion of each of the hydraulic power units 200. When the hydraulic engine 100 stops, the accumulated fluid is extruded and the spring 262 returns to its original state due to its restoring force, thereby enabling the hydraulic engine 100 to start up easily.

To this end, it is preferable that the driving module for controlling a driving signal to be applied to the oscillator 240 of each of the hydraulic power units 200 is additionally used in addition to the hydraulic power units 200.

When the driving module controls the hydraulic power units 200, the hydraulic engine 100 may be configured as follows.

In this case, driving signals are simultaneously applied to two hydraulic power units 200.

When an initial driving signal of the driving module is applied, the oscillator 240 disposed on one of the hydraulic power units 240 is deformed forward to increase a pressure in the hydraulic tube 210, the oscillation tube 300 is deformed, and a force is applied to a fluid in the hydraulic tube 210. The force which is very large due to the oscillator 240 is applied to the fluid in the hydraulic tube 210. Due to the force, the inner check ring 230 is attached to the fluid inlet 232 to continuously close the fluid inlet 232, and the outer check ring 220 whose stiffness is less than that of the wall surface of the hydraulic tube 210 is deformed to make the fluid be extruded through the fluid outlet 222.

The initial driving signal of the driving module is also applied to the oscillator 240 of the other hydraulic power unit 200, the oscillator 240 is deformed backward to reduce a pressure in the hydraulic tube 210, and the oscillation tube 300 is deformed. As the pressure in the hydraulic tube 210 is reduced, the outer check ring 220 is continuously attached to the fluid outlet 222 and the inner check ring 230 opens the fluid inlet 232 to make the fluid be introduced through the fluid inlet 232 in which the inner check ring 230 is mounted.

When the hydraulic power units 200 and all members connected to the hydraulic power units 200 are filled with a fluid and sealed to form a sealed space, cavitation may be prevented from occurring in the fluid by circulating the fluid in a desired direction in the sealed space.

In order to increase the amount of a fluid extruded through the fluid outlet 222, it is necessary to increase the amount of deformation of the oscillator 240, that is, a stroke. In order to increase a stroke, a voltage of electric energy applied to the oscillator 240 may be increased or a plurality of piezoelectric elements included in the oscillator 240 may be stacked.

Also, since the amplitude amplification device 400 is disposed between the oscillator 240 and the oscillation tube 300 as described above and thus the amount of a fluid extruded through the fluid outlet 222 and the amount of a fluid introduced through the fluid inlet 232 may be increased, outputs of the hydraulic power units 200 and the hydraulic engine 100 may be further increased.

FIG. 12 is a view illustrating the insulating oil circulation cooling device 500 and FIG. 13 is a circuit diagram for explaining an operation of the insulating oil circulation dissipation heating device 500.

Referring to FIGS. 12 and 13, the hydraulic engine 100 may include the insulating oil circulation cooling device 500.

The circulation cooling device 500 for dissipating heat generated when the oscillator 240 is driven may be filled with insulating oil that may flow during an operation of the hydraulic power units 200. The insulating oil may flow through a pipeline and dissipate heat through a dissipater, thereby making it possible to maintain a driving temperature of the oscillator 240.

As described above, the cooling nine 340 may be connected to the oscillation tube 300, and the insulting oil circulation cooling device 500 may be connected to the cooling pipe 340.

In this case, the hydraulic power unit 200 may include the first hydraulic power unit 200*a* and the second hydraulic power unit 200*b*. And the insulating oil circulation cooling device 500 may include: a first pipeline 510 that connects the first hydraulic power unit 200*a* and the second hydraulic power unit 200*b*; a third pipeline 522 that has one end connected to a middle portion of the first pipeline 510 and the other end connected to the second hydraulic power unit 200*b* and is provided with a cooling effect of a predetermined cooler; a first check ball receiving portion 516 that is provided on the third pipeline 522; a first check ball 518 that is inserted into the first check ball receiving portion 516 and is elastically deformable; a second check ball receiving portion 521 that is provided on the first pipeline 510 and is disposed between a middle portion to which the third pipeline 522 is connected and the second hydraulic power unit 200*b*; a second check ball 520 that is inserted into the second check ball receiving portion and is elastically deformable; an accumulator 526; a second pipeline 512 that connects the accumulator 526 and the first pipeline 510; and a valve unit 514 that is provided on the second pipeline 512. Also, each pipeline of the insulting oil circulation cooling device 500 may be filled with insulating oil. As the insulating oil flows, heat exchange occurs and the oscillator 240 may be cooled.

An accumulator 526 may be connected to deal with a change in the insulating oil as temperature changes and prevent the insulating oil from being lost as time elapses. The valve unit 514 may be provided to control insulating oil supply through the second pipeline 512. The valve unit 514 may be a throttle valve and may be manipulated to be opened and closed. The operation of the valve unit 514 may be performed by using a handle 515.

An operation of the insulating oil circulation cooling device 500 will be explained below.

For example, when the oscillator 240 in the first hydraulic power unit 200*a* is deformed to introduce a fluid in the hydraulic tube 210, the oscillation tube 300 may be deformed outward, and thus the insulating oil may be extruded along the first pipeline 510 from the insulating oil chamber 330 of the oscillation tube 300.

In this case, the second check ball 520 may be deformed due to the insulating oil, the insulating oil flows to the second hydraulic power unit 200*b* through the first pipeline 510 as marked by an arrow A.

Next, when the oscillator 240 in the second hydraulic power unit 200*b* is deformed to introduce a fluid in the hydraulic tube 210, the oscillation tube 300 is deformed outward, the insulating oil is extruded from the insulating oil chamber 330 of the oscillation tube 300, and the second check ball 520 is deformed to close the first pipeline 510 communicating with the first hydraulic power unit 200*a*. Accordingly, the insulating oil may flow through the third pipeline 522, and in this case, the insulating oil may be cooled by the cooler FAN disposed in the third pipeline 522.

In addition, the insulating oil that has been cooled while passing through the third pipeline 522 may circulate as marked by an arrow B to pass through the first check ball 516 and to be introduced along the first pipeline 510 into the first hydraulic power unit 200*a*. In this case, since the second check ball 520 is closed, the insulating oil that has passed through the first check ball 518 flows to the first hydraulic power unit 200*a*, instead of the second hydraulic power unit 200*b*.

Since the insulating oil circulation cooling device 500 is provided, the oscillator 240 of the hydraulic engine 100 may be efficiently cooled, and thus operational efficiency of the hydraulic engine 100 may be prevented from being reduced.

According to the present invention, a hydraulic engine mainly uses a converse piezoelectric effect in a ceramic oscillator included in each of hydraulic power units constituting the hydraulic engine. Due to the converse piezoelectric effect, a displacement and a large force are generated in the ceramic oscillator according to a driving voltage, a driving frequency, and a rigidity of the ceramic oscillator. Due to the displacement and the large force, since a working fluid strongly impinges on rotor blades, when extruded, the torque of a rotor may be greatly increased. In particular, a flow rate may be arbitrarily changed by adjusting a time when a driving signal is applied.

The hydraulic engine does not require additional power or fuel other than power of a secondary battery included in a driving module that is used to generate a signal applied to the ceramic oscillator included in each of the hydraulic power units. Accordingly, without supplying additional power or fuel, the hydraulic engine may be continuously driven within life spans of the ceramic oscillator and the secondary battery that supplies power needed to apply a driving signal to the ceramic oscillator.

Also, since the hydraulic engine includes an amplitude amplification device and thus an oscillation amplitude of the ceramic oscillator may be further increased, more outputs may be provided.

In addition, since the hydraulic engine includes an insulating oil circulation cooling device formed of ceramic, heat generated during operation may be efficiently dissipated.

While the present invention has been particularly shown and described with reference to exemplary embodiments thereof by using specific terms, the embodiments and terms have been used to explain the present invention and should not be construed as limiting the scope of the present invention defined by the claims. The exemplary embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. A hydraulic engine comprising:

a housing;

a rotor that is rotatably supported in the housing and allows rotor blades to be disposed therearound;

a plurality of hydraulic power units that are disposed around the rotor to be spaced apart from one another; and an output shaft that rotates as the rotor rotates and the output shaft protrudes beyond the housing, wherein each of the plurality of hydraulic power units comprises:

a hydraulic tube that has a cavity therein, allows a fluid inlet through which a fluid may be introduced and a fluid outlet through which a fluid may be extruded to be formed in a surface thereof, and has a front end portion closed, an outer check ring that is formed of an elastic material and is disposed to be attached to the fluid outlet to close the fluid outlet;

an inner check ring that is formed of an elastic material and is disposed to be attached to the fluid inlet to close the fluid inlet in the cavity of the hydraulic tube;

an oscillation tube that comprises an insulating oil chamber that comprises an elastic tube layer in which a cavity is formed and a metal tube layer disposed around an outer circumferential surface of the elastic tube layer, and a transmission holder that is disposed on a rear end portion of the insulating oil chamber and receives a force applied from an oscillator;

an amplitude amplification device that comprises a casing that is disposed under the oscillation tube and has a cavity therein, a swell tube that is disposed in the casing, has a cylindrical shape with a cavity therein, and has a plurality of slits formed in a longitudinal direction in a surface thereof; and an elastic chip that is disposed in the swell tube to cross the cavity of the swell tube;

the oscillator that is disposed under the amplitude amplification device to be deformed toward or away from the hydraulic tube, and increases or reduces a pressure of a fluid in the hydraulic tube and the oscillation tube; and an oscillation front end portion that is partially inserted into the swell tube and is connected to the oscillator.

2. The hydraulic engine of claim 1, wherein when electric energy is applied to the oscillator, the oscillator is deformed due to a converse piezoelectric effect toward or away from the cavity of the hydraulic tube.

3. The hydraulic engine of claim 1, wherein the amplitude amplification device is configured such that a portion of the transmission holder and a portion of the oscillator front end portion are inserted into the cavity of the swell tube, and the elastic chip is disposed between the transmission holder and the oscillator front end portion, wherein the elastic chip is formed of an elastic material and has a restoring force to return to its original shape after being deformed, has a circular plate shape having a curvature and a protruding central portion, and has a plurality of holes formed in a circumferential direction thereof.

4. The hydraulic engine of claim 3, wherein the elastic chip has a plurality of holes, each hole is a fan shape, and the fan shape has an arc that forms a portion of a circumference of the elastic chip.

5. The hydraulic engine of claim 1, wherein a plurality of slits which extend in a longitudinal direction are formed in the metal tube layer.

6. The hydraulic engine of claim 1, wherein a protrusion is formed on an end portion of the elastic tube layer and a groove for receiving the protrusion is formed in an end of the hydraulic tube, the elastic tube layer is fixed to the hydraulic tube.

7. The hydraulic engine of claim 1, wherein the fluid inlet is formed as one or more V-shaped grooves, and the one or more of the V-shaped grooves are formed around the hydraulic tube, and the inner check ring is formed as one or more inner check rings, and each inner check ring is disposed to contact each respective V-shaped groove to close the fluid inlet.

8. The hydraulic engine of claim 1, wherein the fluid outlet is formed as one or more V-shaped grooves, and the one or more of the V-shaped grooves are formed around the hydraulic tube, and the outer check ring is formed as one or more outer check rings, and each outer check ring is disposed to contact each respective V-shaped groove to close the fluid outlet.

9. The hydraulic engine of claim 1, further comprising a front end accumulation unit that is disposed on a closed front end of the hydraulic tube, wherein the front end accumulation unit comprises an accumulation plate, a front end cap, a spring guide tube, and a spring, wherein the spring is disposed between the front end cap and the accumulation plate and applies an elastic force between the front end cap and the accumulation plate.

10. The hydraulic engine of claim 1, further comprising an insulating oil circulation cooling device, wherein the plurality of hydraulic power units comprise a first hydraulic power unit and a second hydraulic power unit, and the insulating oil circulation cooling device comprises: a first pipeline that connects the first hydraulic power unit and the second hydraulic power unit; a third pipeline that has one end connected to a middle portion of the first pipeline and the other end connected to the second hydraulic power unit and is provided with a cooling effect of a cooler; a first check ball receiving portion that is provided on the third pipeline; a first check ball that is inserted into the first check ball receiving portion and is elastically deformable; a second check ball receiving portion that is provided on the first pipeline and is disposed between the middle portion of the first pipeline to which the third pipeline is connected and the second hydraulic power unit; a second check ball that is inserted into the second check ball receiving portion and is elastically deformable; an accumulator; a second pipeline that connects the accumulator and the first pipeline; and a valve unit that is provided on the second pipeline.

11. The hydraulic engine of claim 1, further comprising a sleeve flange on which the rotor and the hydraulic power units may be disposed, wherein the sleeve flange comprises:

a cavity in which the rotor is disposed;

a plurality of arrangement holes that are disposed outside the cavity and allow the hydraulic power units to be disposed therein;

a plurality of extrusion slots that are formed in a front portion of a side surface of the sleeve flange with the cavity and extend in a longitudinal direction; and a plurality of introduction slots that are formed in a rear portion of the side surface of the sleeve flange with the cavity and extend in the longitudinal direction, wherein the rotor comprises double helical blades, and is inserted into the cavity of the sleeve flange.

12. The hydraulic engine of claim 1, further comprising a driving module that drives the hydraulic power units, adjusts the number of rotations and torque of the rotor, and comprises a secondary battery as a driving power source.

* * * * *